US005786661A

United States Patent [19]

Kim

[11] Patent Number: 5,786,661

[45] Date of Patent: Jul. 28, 1998

[54] FERRITE CORE WITH CONCAVE AND CONVEX PORTIONS

[75] Inventor: Gyoo Wan Kim, Kumi, Rep. of Korea

[73] Assignee: LG Electronics Inc., Seoul, Rep. of Korea

[21] Appl. No.: 742,574

[22] Filed: Oct. 28, 1996

[30] Foreign Application Priority Data

Oct. 26, 1995 [KR] Rep. of Korea ..... 37377/1995

[51] Int. Cl.[6] ..... H01J 29/70; H01F 7/00

[52] U.S. Cl. ..... 313/440; 335/210; 335/211

[58] Field of Search ..... 313/440, 431, 313/433, 413; 335/213, 211, 210, 212

[56] References Cited

U.S. PATENT DOCUMENTS 3,163,794 12/1964 Bloomsburg et al. ..... 313/440

4,841,267 6/1989 Watabe et al. ..... 335/210

5,402,091 3/1995 Ikeuchi ..... 335/213

*Primary Examiner*—George M. Dombroske

*Assistant Examiner*—Harshad Patel

*Attorney, Agent, or Firm*—Fish & Richardson P.C.

[57] ABSTRACT

A ferrite core for a deflection yoke of a CRT includes concave and convex portions for correcting a raster distortion of the deflection yoke by varying a magnetic path at one end of a screen portion of the ferrite core. The ferrite core may be incorporated in a deflection yoke that includes a horizontal deflection coil for deflecting electron beams emitted from an electron gun in the horizontal direction, a vertical deflection coil for deflecting the electron beams in the vertical direction, and a holder for fixing the horizontal deflection coil and the vertical deflection coil to given positions and separating them from each other. The ferrite core also prevents a magnetic force caused by the horizontal and vertical deflection coils from being reduced.

5 Claims, 5 Drawing Sheets

FERRITE CORE WITH CONCAVE AND CONVEX PORTIONS

BACKGROUND OF THE INVENTION

The invention relates to a ferrite core of a deflection yoke for a cathode-ray tube (CRT).

FIGS. 1–3 illustrate a conventional deflection yoke 10 for a CRT 15. The yoke 10 includes a horizontal deflection coil 20, a vertical deflection coil 25, a coneshaped ferrite core 30, a coil separator 35, and a magnet 40 or a cross-arm (not shown). An electron gun 45 emits electron beams and is mounted in a neck portion 50 at the rear of the CRT 15. The horizontal deflection coil 20 is wound by a saddle winding so that a magnetic field produced by the coil 20 deflects the electron beams in a horizontal direction. The vertical deflection coil 25 is wound by a troidal winding so that a magnetic field produced by the coil 25 deflects the electron beams in the vertical direction. The cone-shaped ferrite core 30 improves magnetic efficiency by reducing losses of magnetic energy produced by the deflection coils 20, 25. The coil separator 35 maintains the coils 20, 25 and the core 30 in their assigned positions and separates the coils from each other. The magnet 40 (or the cross-arm) is attached to a screen portion 55 of the deflection yoke 10 to correct raster distortion.

When the deflection yoke 10 utilizes a NTSC mode, current having a frequency of 15.75 KHz is applied to the horizontal deflection coil 20 and current having a frequency of 60 Hz is applied to the vertical deflection coil 25. In this case, the electron beams are deflected in the horizontal direction by a pincushion magnetic field produced by the horizontal deflection coil 20. In addition, the electron beams are deflected in the vertical direction by a barrel magnetic field produced by the vertical deflection coil 25. In a process called self-convergence, the electron beams can be made to converge on a screen 60 by the magnetic fields produced by the coils 20, 25.

The pincushion magnetic field and the barrel magnetic field are formed by adjusting the winding of the deflection coils 20, 25 at different portions (the screen portion 55, a central portion 65, and a neck portion 70) of the deflection yoke 10. A different deflection force is given to the electron beams depending on the positions at which the electron beams are deflected onto the screen 60. As a result, the beams can be made to converge at the same position even if the distance travelled by the beams from the starting point to the screen 60 varies.

For larger and more planar screens, raster distortion as depicted by the dotted line of FIG. 6 may occur. Additional components such as the magnet 40 or a cross-arm may be used to correct the raster distortion. However, this may increase the manufacturing cost and assembly complexity of the deflection yoke, which is undesirable.

SUMMARY OF THE INVENTION

The invention provides a ferrite core for a deflection yoke for a CRT in which raster distortion is effectively corrected by a magnetic force focused on a predetermined portion of the ferrite core. The ferrite core of the invention has a number of advantages. For example, a magnetic force may be focused on a convex portion of the core to correct the raster distortion without using additional components such as a magnet or a cross-arm. As a result, the manufacturing cost and the assembly complexity of the deflection yoke may be reduced. The ferrite core of the invention also provides increased flexibility in designing the horizontal and vertical deflection coils.

In one aspect, generally, the invention features a ferrite core of a deflection yoke for a CRT. The ferrite core has concave and convex portions in a screen portion thereof. A coil may be wound in a convex portion of the core or an auxiliary holder may be inserted into the convex portion.

Other features and advantages of the invention will be apparent from the following description, including the drawings, and from the claims.

DESCRIPTION OF THE PREFERRED EMBODIMENTS

Figure 1:
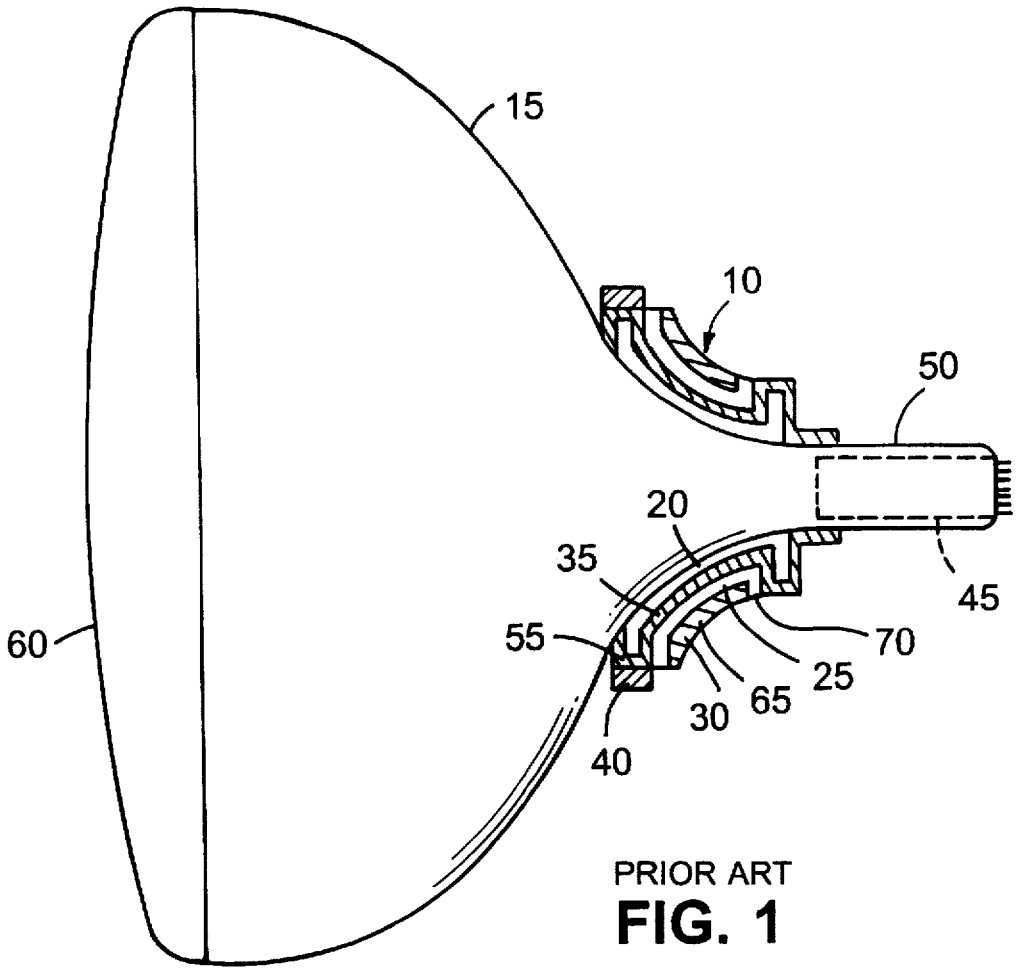
PRIOR ART FIG. 1
FIG. 1 is a sectional view of a CRT including a conventional deflection yoke.
Figure 2:
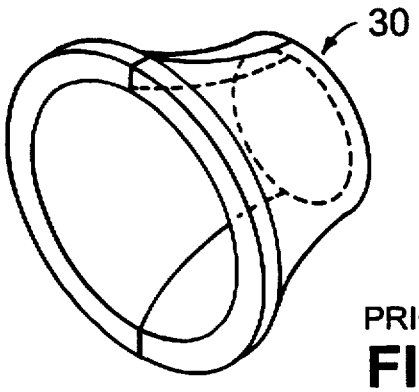
PRIOR ART FIG. 2
FIG. 2 is perspective view of a ferrite core of the yoke of FIG. 1.
Figure 3:
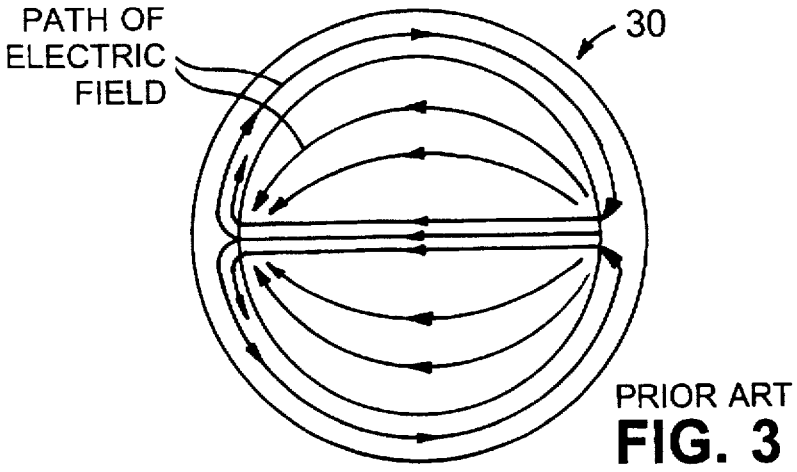
PRIOR ART FIG. 3
FIG. 3 is a sectional view of a magnetic field in a screen portion of the ferrite core of FIG. 2.
Figure 4:
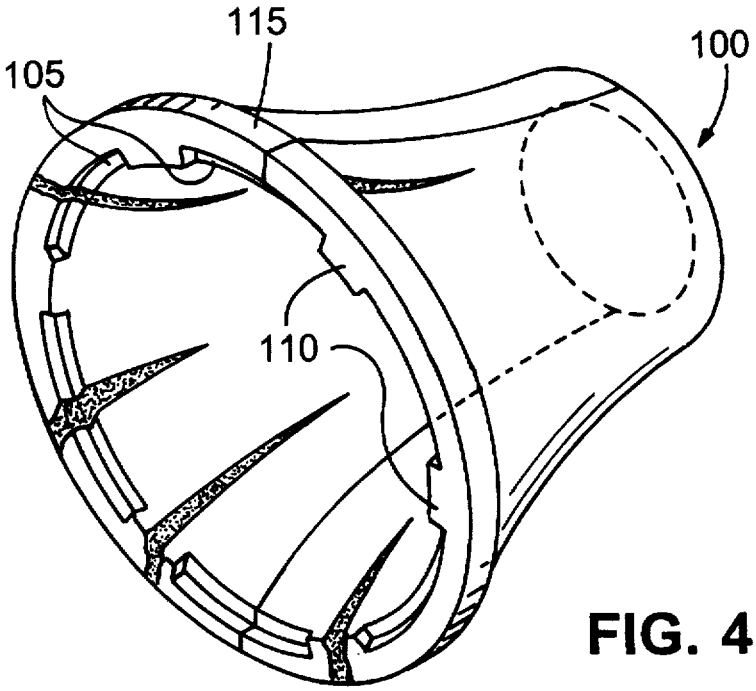
FIG. 4 is a perspective view of a ferrite core of an embodiment of the invention.
Figure 5:
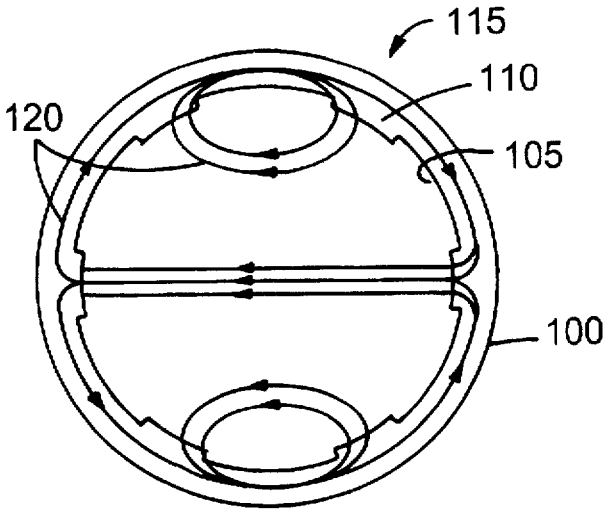
FIG. 5 is a sectional view of a magnetic field in a screen portion of the ferrite core of FIG. 4.

Referring to FIG. 4, a ferrite core 100 according to the invention includes concave portions 105 and convex portions 110 at the screen portion 115 of the core. As shown in FIG. 5, the concave and convex portions 105, 110 vary the magnetic field 120 formed at the screen end 115 of the core 100 when the core is mounted in a deflection yoke 10. Since a magnetic field generally forms along a shorter path, application of a current to the horizontal and vertical deflection coils 20 and 25 results in focusing of the magnetic force on the convex portions 110.

Figure 6:
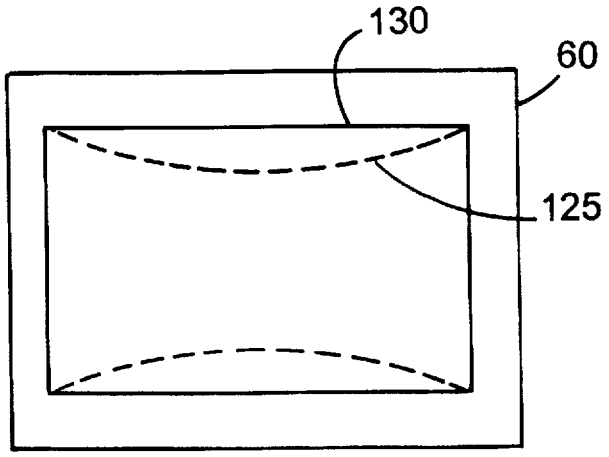
FIG. 6 is a front view of a screen of a CRT showing states before and after correction of raster distortion.

The width of the convex portions 110 may be adjusted so that a portion of the screen on which the raster distortion is heavier than any other portions is affected by electron beams passing between the convex portions 110. Thereafter, the raster distortion can be corrected by the magnetic force focused at the convex portions 110. FIG. 6 illustrates the correction of the raster distortion, where dotted line 125 indicates the raster distortion and solid line 130 indicates a corrected state of the raster distortion.

Figure 7A:
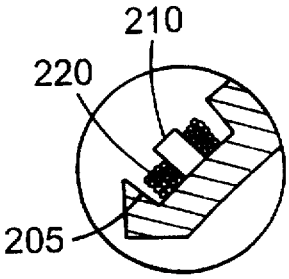
FIGS. 7 and 8 are perspective views of other embodiments of the invention.
Figure 7:
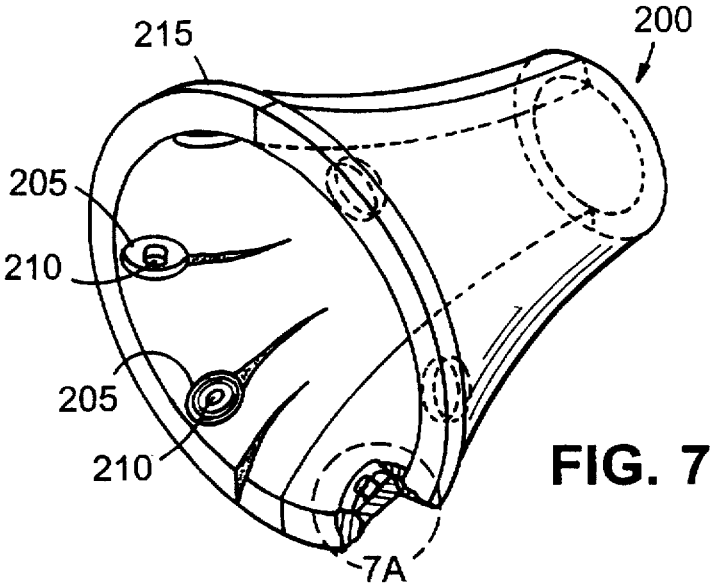
Figure 7B:
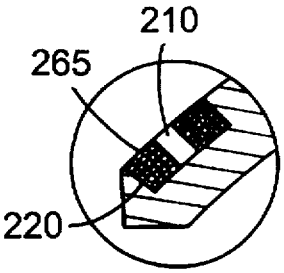
Figure 9:
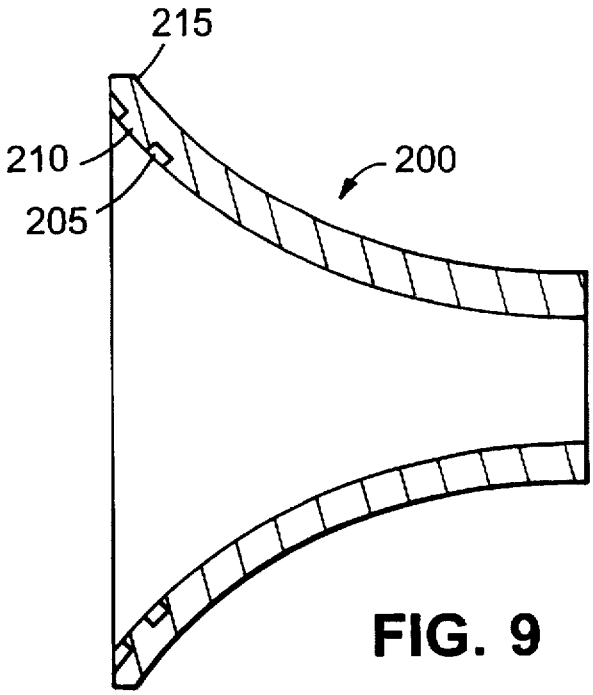
FIG. 9 is a sectional view of the ferrite core of FIGS. 7 and 8.

FIGS. 7 and 9 illustrate another core 200 in which concave portions 205 and convex portions 210 are formed into the screen portion 215 of the core 200. The convex portions 210 may be wound by a coil 220. As shown, the convex portions 210 are in the form of rods. The convex portions 210 also may be formed as cones or polygons.

The magnetic field produced by the core 200 is similar to the path produced by the core 100. However, when a convex portion 210 is wound by a coil 220, a powerful magnetic force occurs at the convex portion 210. As a result, the raster distortion can effectively be corrected and the intensity of the magnetic force can be adjusted depending on the winding of the coil.

Figure 8:
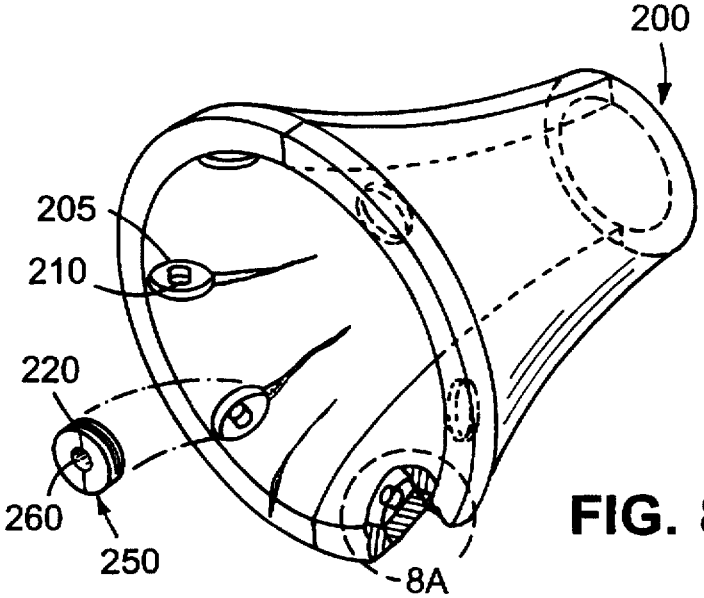
Figure 10:
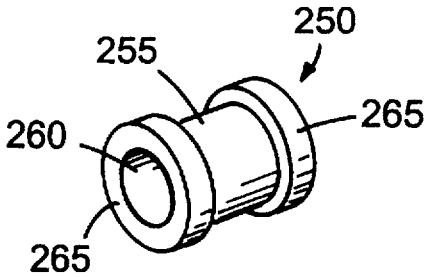
FIG. 10 is a perspective view of an auxiliary holder of the ferrite core of FIG. 8.

As shown in FIGS. 8–10, a coil may be placed around a convex portion 210 by attaching an auxiliary holder 250 to the portion 210. The holder 250 includes a concave portion 255 on which a coil 220 may be wound and a hollow portion 260 in which the convex portion 210 of the core 200 may be inserted. The enlarged ends 265 of the holder 250 prevent separation of the coil from the auxiliary holder 250. This configuration may serve to simplify the process of assembling the deflection yoke 200 by eliminating the need to wind the coil on the convex portion 210. (FIGS. 8 and 10 show holders 250 having different dimensions, with the holder of FIG. 8 being configured to hold a short and wide coil and the holder of FIG. 10 being configured to hold a tall and narrow coil.)

Other embodiments are within the scope of the following claims.

What is claimed is:

1. A ferrite core for a deflection yoke of a CRT, the deflection yoke having a horizontal deflection coil for deflecting electron beams emitted from an electron gun in the horizontal direction, a vertical deflection coil for deflecting the electron beams in the vertical direction, and a holder for fixing the horizontal deflection coil and the vertical deflection coil to respective given positions and separating them from each other, the ferrite core preventing a magnetic force caused by the horizontal and vertical deflection coils from being reduced and comprising:

a plurality of concave and convex portions positioned and configured to correct a raster distortion of the deflection yoke by varying a magnetic path at one end of a screen portion of the ferrite core.

2. The ferrite core of claim 1, wherein the concave and convex portions are formed inside the screen portion of the ferrite core, and a convex portion is wound by a coil.

3. The ferrite core of claim 1, wherein a convex portion receives an auxiliary holder wound by a coil.

4. The ferrite core of claim 3, wherein the auxiliary holder includes a hollow portion sized to receive the convex portion.

5. The ferrite core of claim 1, wherein the concave and convex portions are located at only a single end of the ferrite core.

* * * * *